US005516217A

United States Patent [19]

Alexander et al.

[11] Patent Number: 5,516,217

[45] Date of Patent: May 14, 1996

[54] DOCUMENT GUIDING RIBBON CARTRIDGE

[75] Inventors: Douglas E. Alexander; Richard H. Harris; Jeff D. Thomas, all of Raleigh, N.C.

[73] Assignee: International Business Machines Corporation, Armonk, N.Y.

[21] Appl. No.: 475,257

[22] Filed: Jun. 7, 1995

[51] Int. Cl.[6] ..... B41J 35/28; B41J 32/02

[52] U.S. Cl. ..... 400/207; 400/578; 400/642

[58] Field of Search ..... 400/207, 208, 400/208.1, 250, 247, 248, 679, 642, 644, 578

[56] References Cited

U.S. PATENT DOCUMENTS

| | | | |
|---|---|---|---|
| 4,197,023 | 4/1980 | DeBoo et al. | 400/578 |
| 4,197,025 | 4/1980 | Kuelzer | 400/647.1 |
| 4,444,522 | 4/1984 | Suzuki et al. | 400/146 |
| 4,773,779 | 9/1988 | Wyne | 400/247 |
| 4,840,507 | 6/1989 | Chenest | 400/713 |
| 5,074,689 | 12/1991 | Martinez | 400/208 |
| 5,098,208 | 3/1992 | Martinez | 400/208 |

FOREIGN PATENT DOCUMENTS

| | | | |
|---|---|---|---|
| 61-228978 | 10/1986 | Japan | B41J 32/00 |
| 4-255377 | 9/1992 | Japan | B41J 15/04 |

OTHER PUBLICATIONS

W. Goff, Jr. and R. A. Rachui; IBM Technical Disclosure Bulletin; "Cardholder–Ribbon Guide Combination for Printers"; IBM Corp. 1979; vol. 21, No. 12, May 1979; pp. 4744–4746.

*Primary Examiner*—Edgar S. Burr
*Assistant Examiner*—Dan Colilla
*Attorney, Agent, or Firm*—George E. Clark; John D. Flynn

[57] ABSTRACT

An improved print ribbon cartridge, having a plurality of paper guide means therein capable of preventing the fouling of paper at the time of printing, for use with a typewriter or printer having a platen, a carrier movable along the platen which supports the cartridge, a print head supported on the carrier for operating in conjunction with the print ribbon in the cartridge to cause printing on a document.

4 Claims, 3 Drawing Sheets

DOCUMENT GUIDING RIBBON CARTRIDGE

BACKGROUND OF THE INVENTION

1. Field of the Invention

This invention generally relates to print ribbon cartridges for printers and typewriters, and more particularly to a print ribbon cartridge having a document guide.

2. Prior Art

A computer printer is a device used to record the output of a computer in a permanent form. Although this is a simple and straightforward premise, the actual process of transcribing computer-generated information onto paper is not easy. An assortment of electrical and mechanical components (as well as optical and chemical components in some cases) work together to form printed pages correctly and reliably.

One of the more popular printing technologies in use today is impact printing. The technique of impact printing is just as the name implies—characters (or graphics) are physically struck onto a page through an inked ribbon. Several types of impact printers are known. Many include a fixed platen and a movable print head carriage including a plurality of spaced print wires which are selectively activated and driven into a ribbon and the paper as the head moves across the paper. Because print wires can be fired in any combination, it is possible to print more than one font style, as well as custom characters or graphics.

In these wire matrix or dot matrix computer printers, the printing mechanism is positioned very close to the platen. An inked ribbon is also positioned very close to the print head, between the print head and the platen. The paper which rests against the platen has very little clearance between the surface of the platen and the ribbon. While this is an excellent arrangement for high speed matrix printing, it leads to difficult paper insertion because of the very limited space between the ribbon and the platen.

Further, a moving print head carriage has a tendency to snag on portions of paper inserted in a printer. This snagging potential is especially prevalent at edges of paper such as multiple part forms and at "outfolds" where sections of continuous fan-fold paper are connected by flexible paper hinges which project out from the platen and into the moving print head. These printers also have difficulty handling multipart carbon forms like sheet paper, order forms, and charge forms. The forms can easily crumple up inside the printer causing user annoyance as well as damage to the printer.

As such, there have been a number of attempts to solve this problem through devices for guiding the paper in printing equipment during paper transport. For example, document guides have been incorporated into the typewriter or printer itself, such as that seen in U.S. Pat. No. 4,444,522.

Unfortunately, these type of paper guides increase the cost of fabrication and assembly of the printer. In addition, should the prior art paper guide attached to the printer break, the entire printer would likely have to be transported to a service establishment for repair.

Paper guides have also been incorporated into the ribbon cartridge, but the cartridge travels with the print head and leaves a larger width of the document unguided.

Japanese patent 61-228978, entitled Ink Ribbon Cartridge, shows a ribbon cartridge having an expandable ribbon guide for protection of the ribbon from contamination. The ribbon guide has a window for exposing a part of the ribbon for printing.

Although the patent shows an accordion like ribbon guide, it does not teach nor suggest a ribbon cartridge having a document guide as is taught and claimed herein.

U.S. Pat. Nos. 5,074,689 and 5,098,208 both entitled Ribbon Cassette with Integral Paper Guide, show a ribbon cartridge having a platen like curved member along the front of the cartridge for guiding paper between the print head and the print platen.

Although these patents show a ribbon cartridge having an integral paper guide, they do not teach nor suggest a ribbon cartridge having a document guide as is taught and claimed herein.

SUMMARY OF THE INVENTION

Accordingly, it is a primary object of the present invention to provide a print ribbon cartridge for a typewriter or printer that has all the advantages of similarly employed prior art cartridges and provides a unique document guide capable of preventing the fouling of paper at the time of printing.

An improved print ribbon cartridge, for use with a typewriter or printer having a platen, a carrier movable along the platen which supports the cartridge, a print head supported on the carrier for operating in conjunction with the print ribbon in the cartridge to cause printing on a document, having a plurality of paper guide means therein capable of preventing the fouling of paper at the time of printing.

The foregoing has outlined rather broadly the features and technical advantages of the present invention so that the detailed description of the invention that follows may be better understood. Additional features and advantages of the invention will be described hereinafter which form the subject of the claims of the invention. It should be appreciated by those skilled in the art that the conception and the specific embodiment disclosed may be readily used as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The accompanying drawings, which are incorporated in and form a part of the specification, illustrate the embodiments of the present invention, and, together with the description, serve to explain the principles of the invention. In the drawings.

Figure 1:
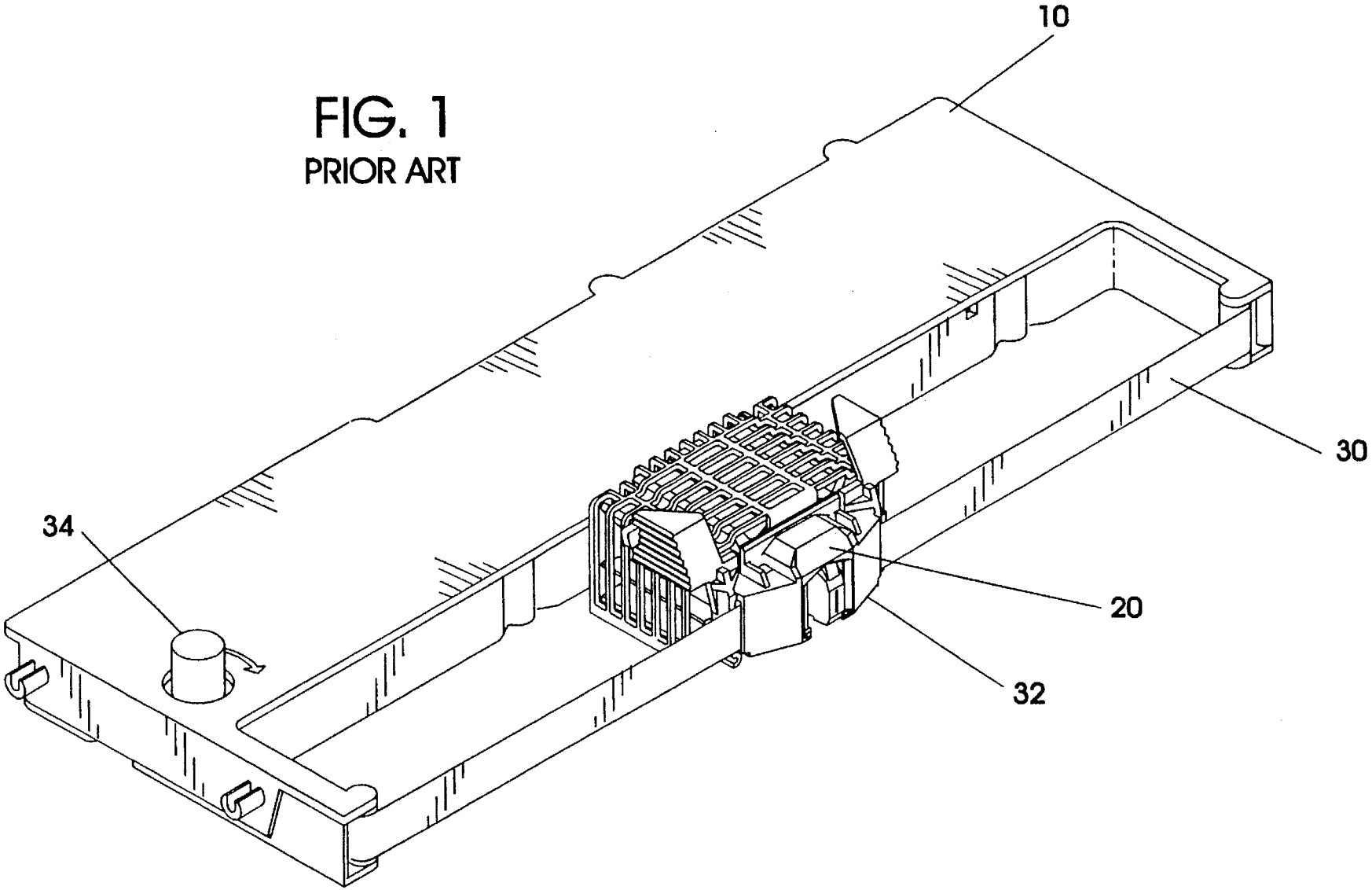
FIG. 1 PRIOR ART
FIG. 1 is a pictorial view of a print head and ribbon cartridge of a prior art computer printer.

It is to be noted that the drawings illustrate only typical embodiments of the invention and are therefore not to be considered limiting of its scope, for the invention will admit to other equally effective embodiments.

DETAILED DESCRIPTION OF THE INVENTION

No matter how diverse or unique printers appear to be from one model to the next, their differences are primarily cosmetic. Each printer might use different individual components, but every printer must perform a similar set of actions. As a result, most printers can be divided into five functional areas: paper feed, print head, print head carriage, ink supply, and electronic control package. The first four are of importance in the present application.

First, every printer must handle paper. Paper must be picked up, carried in front of the print head, then delivered out of the printer intact. The two classical methods of achieving paper transport are tractor-feed and friction-feed. A typical tractor-feed paper transport assembly uses continuous-form paper with holes perforated along both sides. The holes mesh exactly with the teeth of a set of plastic sprocket wheels linked to the platen drive train which evenly pull the paper up and out of the printer. In a friction-feed transport assembly, the paper is clamped into place and advanced by pressure rollers which are brought into tight contact with the paper and the platen.

Second, a print head is a device that applies permanent print to the page surface. Four major technologies have evolved to accomplish this process: impact, thermal, ink jet, and electrostatic. A printer is often categorized by the particular technology that it uses (e.g., thermal dot matrix printer or ink jet printer).

Impact technology is just what the name implies—characters, symbols, and (sometimes) graphics are literally struck onto a page surface through an inked ribbon of fabric or plastic. The force of impact leaves an ink impression of whatever was to be printed. A character print head is little more than a print wheel containing a fixed selection of preformed letters, numbers, punctuation, or other symbols. Dot matrix print heads use a series of individual metal pins or wires that can be independently fired to form any letter, number, symbols, or graphics image as the print head moves across the page.

Impact printers use a ribbon to supply the ink, which is ultimately transferred to a page surface. Fabric or plastic ribbons are typically used with impact printers. The ribbons are long, porous strips of material that are saturated with liquid ink. Ribbons are typically black, but colored ribbons can be used. Multicolored ribbons are used in some impact printers to provide a range of colors on the same page. They are either spooled around a ribbon bobbin or packed into a plastic cassette or cartridge. Regardless of what type of ribbon is used, it must be advanced continuously so a fresh ribbon area is always available to the print head.

Third, most print heads must be carried back and forth across the page. This movement is accomplished by a print head transport mechanism, or carriage. In some printers, the carriage transport system moves along a set of rails driven by a simple pulley system. As one can imagine, the process of moving a print head becomes a serious concern. The head must move at the proper time, at the proper speed, and over the proper distance to within several thousandths of an inch—on every pass.

As discussed above, wire matrix printers used with personal computers, work stations, and point-of-sale terminals have difficulty handling forms like sheet paper, order forms, and charge forms. These forms may have sheets of carbon paper interposed between adjacent sheets of paper. These can easily crumple up inside the printer causing user annoyance as well as damage to the printer. This problem occurs because the print head access to the paper requires clearance within a slot that extends at least the distance of the print line. The only area where forms are prevented from entering this slot is the position of the print head. The print head spans only a small distance and cannot guide both edges of the form unless the form is very narrow. Current designs require space consuming and closely toleranced form deflectors that are only partially effective at best.

There is shown in FIG. 1 a pictorial view of a print head and ribbon cartridge of a prior art computer printer. A ribbon cartridge 10 includes a ribbon 30, transported by ribbon advance 34. The ribbon 30 is guided, in part, by ribbon guide 32. Transports for ribbon cartridges are often unidirectional, that is, ribbon is advanced in one direction until it wears out. A typical fabric ribbon can survive many complete passes before wearing out.

A print head 20 is mounted to a carriage which transports the print head 20 left and right across a page surface. As the head 20 moves, it places a series of vertical dots that creates the image. In normal operation, the document or paper being printed on takes a path directly in front of the ribbon 30. From time to time, however, a misdirected document passes behind the ribbon 30 due to a lack of guide surfaces in the area where the print head 20 passes.

Figure 2:
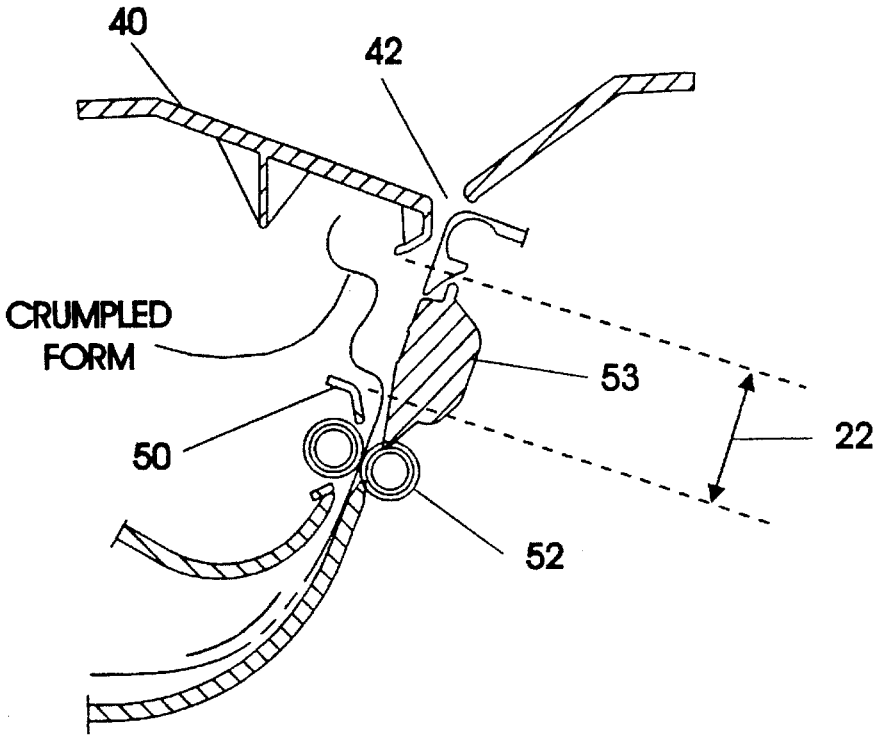
FIG. 2 PRIOR ART
FIG. 2 is a cross-sectional side view of the paper path of the prior art computer printer depicted in FIG. 1.

As seen in FIG. 2, there is shown a paper path through a cross-sectional side view of the prior art device depicted in FIG. 1. In proper operation, the document or form 60 is fed into the bottom of the printing mechanism and passes through feed rolls 52, printer frame 50, across platen 53, and exits through a small opening or paper exit slot 42 in the printer cover 40. For aesthetic as well as practical reasons such as noise control, structural integrity, and operator safety, the paper exit opening 42 should be as small as possible. Such a desirably small opening exposes as little as possible of the interior machinery of the printer to the hazards of damage or the possibility of injury to an operator or others.

When a new sheet of paper is inserted into the printer, it is squeezed between feed rolls 52 beneath platen 53 such that rotation of the feed rolls 52 assures that the paper is carried across the platen 53. The paper, however, possesses a moderate amount of stiffness which will vary with many factors including ambient humidity and has a tendency to extend tangentially from the platen at any location at which it is not closely guided to a desired path.

The print head 20 requires a gap or clearance 22 to move from one end of the ribbon cartridge 10 to the other end. Unfortunately, the form 60 being fed through the printing mechanism may pass behind the ribbon 30 at the site of this gap 22 and not through the small opening 42 of the printer cover 40. The form 60 becomes torn or crumpled, and thus ultimately jamming the printer. This becomes a serious matter especially when high volume continuous stationery is being used.

Figure 3:
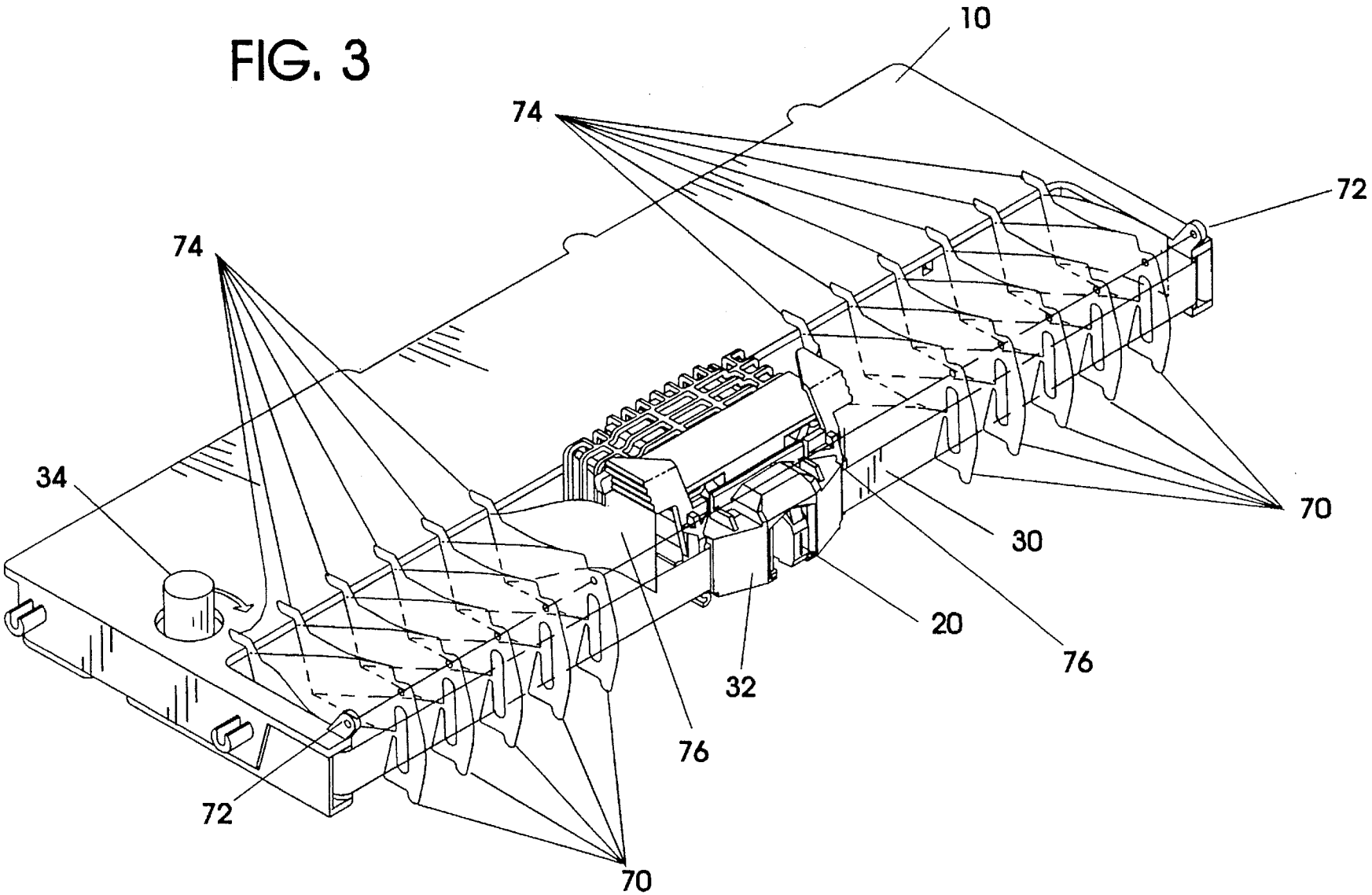
FIG. 3 is a pictorial view of a ribbon cartridge according to the present invention with a print head in place.

In contrast, the present invention provides effective forms guiding with a simple addition to the ribbon cartridge. Turning now to FIG. 3, there is shown a pictorial view of the ribbon cartridge 10 of a preferred embodiment of the present invention. As is well known in the art, ribbon cartridges provide storage for a quantity of print ribbon as well as means which coact with the typewriter or printer on which the cartridge is mounted, to mechanically move the ribbon in a loop, from an exit to an entrance opening in the cartridge. In general, the cartridge is horizontally supported within a typewriter or printer on a movable carder for lateral movement along the platen. The cartridge is not only supported on the carrier but is releaseably affixed to the carrier so that it may be readily inserted and removed from the carrier when it is to be replaced. Although the ribbon cartridge has been described with respect to dot matrix printing, it may be readily adapted for other forms of printing such as thermal printing or impact daisy wheel.

FIG. 3 also shows a plurality of document guides 70 that move as the print head 20 traverses the print line. The edge of the bifolds 70 act as moving form guides that fill the gap 22 left by the print head as discussed above. The outer extreme guides of bifolds 70 are fixed to ribbon cartridge 10 at points 72 and the inner extreme guides of bifold 70 are fixed to ribbon guide 32 at points 76. The other guides of bifold 70 are slidably guided by ribbon cartridge 10 at points 74. The guide portions of the bifolds 70 may take a variety of cross-sectional shapes including straight, angular, as well as arcuate or any combination thereof. The particular shape selected will be dependent on such variables as stiffness of the printing media and the spacing between the ribbon cartridge and the platen. The bifold guides 70 cooperate with the stationary document guiding parts of the printer to present virtually continuous guiding of a document regardless of the location of the print head 20.

Figure 4:
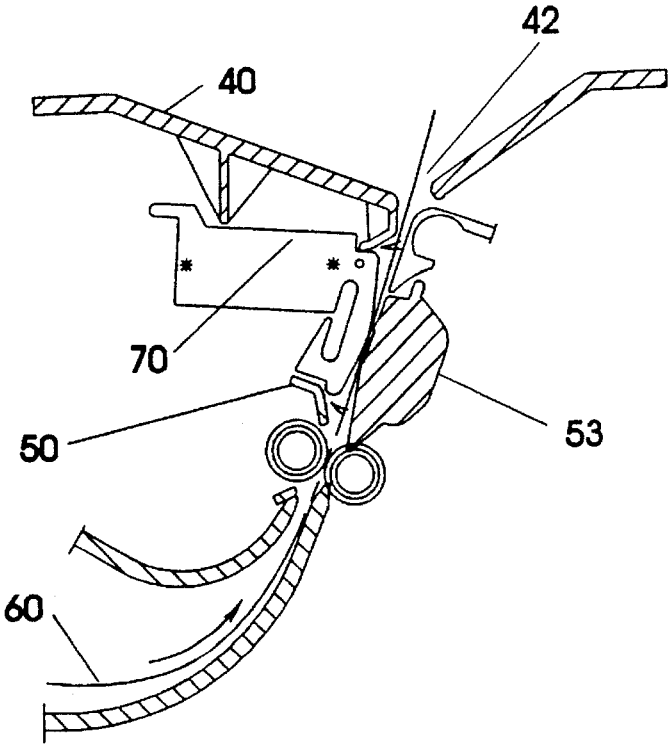
FIG. 4 is a cross-sectional side view of a printer including a ribbon cartridge according to the present invention as depicted in FIG. 3.

FIG. 4 is a cross-sectional side view showing the position of a bifold 70 of the present invention. It is nearly impossible for a form 60 to enter the gap 22 of the printer mechanism and become crumpled since the bifolds 70 are guided by the frame 50 below and the cover 40 above. If desired, guiding the bifolds 70 can be provided by the ribbon cartridge 10. The disclosed ribbon cartridge allows excellent forms guiding whether the form is inserted from the top or the front of the printer. It can be constructed of inexpensive plastic. An additional feature is that the bifolds are replaced with the ribbon and as such can have a much lower life expectancy than the printer mechanism.

In its use, the platen of the printer is quite wide, and the printing mechanism traverses from one end of the platen to the other in order to span the width of the paper and print rows of alphanumeric indicia thereon. When the printing mechanism is at its customary idle location near the left margin of the paper on the platen, the rightmost edge of the paper is unsupported beyond the end of the print head except for the bifolds, without which the paper may tend to jam. As the printing mechanism traverses from one end to the other of the platen, it bends the flexible bifolds on the side of the printing mechanism causing the spacing on one side to proportionably increase and the spacing on the other side to proportionably decrease.

The additional cost of fabricating a paper guide formed as an integral part of a ribbon cartridge is relatively insignificant as compared with the cost of manufacturing a separate paper guide element for incorporation into the typewriter. In addition, should the prior art paper guide attached to the typewriter break, the entire typewriter would likely have to be transported to a service establishment for repair. In contrast, any defect in the paper guide of the present invention merely requires replacement of the cartridge with a new cartridge.

Although the present invention and its advantages have been described in detail, it should be understood that various changes, substitutions and alterations can be made herein without departing from the spirit and scope of the invention as defined by the appended claims.

What is claimed is:

1. A ribbon cartridge for providing a source of ink for printing, comprising:

a housing;

a supply of inked ribbon;

a repository for storing used ribbon; and a plurality of guides, each of said guides having a first end in slidable contact with said housing, and having a second end having a document guide surface for guiding a document during printing.

2. A ribbon cartridge according to claim 1, wherein each said guide comprises a bifold member which moves as a print head traverses a platen of a printer in which said ribbon cartridge is installed.

3. A ribbon cartridge according to claim 1, wherein said second end of each said guide further comprises a ribbon supporting opening.

4. A ribbon cartridge according to claim 1, wherein said document guide surface of each said guide is configured to approximate a configuration of a print head.

* * * * *